US010914449B2

(12) United States Patent
Ruiz et al.

(10) Patent No.: US 10,914,449 B2
(45) Date of Patent: Feb. 9, 2021

(54) COOLING DEVICE FOR AN AUTOMOTIVE LUMINOUS DEVICE

(71) Applicant: VALEO ILUMINACION, Martos (ES)

(72) Inventors: Francisco Ruiz, Martos (ES); Santos Tudela, Martos (ES); Sergio Infante, Martos (ES); Alvaro Andres, Martos (ES); Miguel-Angel Lobato, Martos (ES); Borja Martinez Arias, Martos (ES)

(73) Assignee: VALEO ILUMINACION, Martos (ES)

( * ) Notice: Subject to any disclaimer, the term of this patent is extended or adjusted under 35 U.S.C. 154(b) by 0 days.

(21) Appl. No.: 16/392,766

(22) Filed: Apr. 24, 2019

(65) Prior Publication Data

US 2019/0331313 A1 Oct. 31, 2019

(30) Foreign Application Priority Data

Apr. 27, 2018 (EP) ..... 18382297

(51) Int. Cl.

| | |
|---|---|
| ***F21S 45/47*** | (2018.01) |
| ***F21V 29/67*** | (2015.01) |
| ***F21V 29/76*** | (2015.01) |
| ***F21V 29/80*** | (2015.01) |
| ***F21S 45/43*** | (2018.01) |
| ***F21Y 115/10*** | (2016.01) |
| ***F21S 41/141*** | (2018.01) |

(52) U.S. Cl.

CPC ..... *F21S 45/47* (2018.01); *F21S 45/43* (2018.01); *F21V 29/673* (2015.01); *F21V 29/677* (2015.01); *F21V 29/763* (2015.01); *F21V 29/80* (2015.01); *F21S 41/141* (2018.01); *F21Y 2115/10* (2016.08)

(58) Field of Classification Search

CPC ..... F21S 45/47; F21S 45/43; F21S 41/141; F21V 29/673; F21V 29/677; F21V 29/763; F21Y 2115/10

See application file for complete search history.

(56) References Cited

U.S. PATENT DOCUMENTS

2009/0262550 A1* 10/2009 Inoue ..... F21S 41/148 362/547
2009/0316425 A1* 12/2009 Inoue ..... F21V 29/67 362/547

(Continued)

FOREIGN PATENT DOCUMENTS

EP 2 112 427 A1 10/2009
EP 2 138 759 A1 12/2009

OTHER PUBLICATIONS

European Search report dated Jul. 4, 2018 in European Application 18382297.2, filed on Apr. 27, 2018.

*Primary Examiner* — Mary Ellen Bowman
(74) *Attorney, Agent, or Firm* — Oblon, McClelland, Maier & Neustadt, L.L.P.

(57) ABSTRACT

A cooling device for cooling a light source located in an automotive luminous device. This cooling device includes a heat sink intended to be in thermal contact with the light source, a plurality of fins in direct thermal contact with the heat sink, a plurality of pins in direct thermal contact with the heat sink and a fan. The fan is arranged to make a fluid flow from an inlet of the cooling device to an outlet to the cooling device, so that the plurality of fins are nearer the inlet than the plurality of pins.

19 Claims, 2 Drawing Sheets

(56) References Cited

U.S. PATENT DOCUMENTS

| | | | | |
|---|---|---|---|---|
| 2015/0138769 | A1* | 5/2015 | Chen | F21K 9/00 362/240 |
| 2015/0176791 | A1* | 6/2015 | Ahn | F21S 41/16 362/516 |
| 2016/0223183 | A1* | 8/2016 | Zou | F21V 29/80 |

* cited by examiner

COOLING DEVICE FOR AN AUTOMOTIVE LUMINOUS DEVICE

TECHNICAL FIELD

This invention is related to the field of heat dissipation in automotive luminous devices.

STATE OF THE ART

Light sources generate a big amount of heat which needs to be dissipated, so that the operation of said light sources is not jeopardized. This issue is even more important when light sources are light emitting diodes (LEDs), since temperature has a big impact on the operational properties of said light sources.

Heat sinks with fins are known to solve this problem. A heat sink is located in thermal contact with the light source, and this heat sink is provided with fins, which dissipate the heat coming from the heat sink, so that air surrounding the fins is heated and then wasted.

Sometimes, a fan is also used to create a forced fluid flow which improves the thermal behaviour of this heat sink. Any improvement in the thermal performance of these elements is crucial, due to the small size of modern automotive luminous devices and the increasing number of individual LEDs which are usually used to achieve the different lighting and signalling functionalities.

DESCRIPTION OF THE INVENTION

The invention provides a solution for a heat dissipation arrangement which achieves a great thermal performance by means of a cooling device according to claim 1 and an automotive luminous device according to claim 11. Preferred embodiments of the invention are defined in dependent claims.

In an inventive aspect, the invention provides a cooling device for cooling a light source located in an automotive luminous device, the cooling device comprising

- a heat sink intended to be in thermal contact with the light source,
- a plurality of fins in direct thermal contact with the heat sink
- a plurality of pins in direct thermal contact with the heat sink
- a fan arranged to make a fluid flow from an inlet of the cooling device to an outlet to the cooling device, so that the plurality of fins are nearer the inlet than the plurality of pins.

Such a cooling device is configured to create an air flow which dissipates a great amount of heat from the pins and the fins. The fan creates a fluid flow where air crosses the fins before the pins. Such an arrangement where the fluid sees the fins before the pins make this flow arrive at the pins in good orientation, so that, advantageously, heat dissipation is improved.

In some particular embodiments, the fan is nearer the inlet than the plurality of fins. In other particular embodiments, the fan is nearer the outlet than the plurality of pins.

In the first alternative, the fan creates a fluid flow and blows the flow towards the fins so that the flow crosses the fins, then the pins and then exits the cooling device. In the second alternative, air is sucked from the fan, which is located near the outlet or in the outlet itself, so that air crosses the fins, then the pins, then the fan and then exits the cooling device. The first arrangement is useful when a big flow is needed, although may result less efficient. The second arrangement is more efficient, since turbulences are minimized or avoided.

In some particular embodiments, when the fluid is moved by the fan, it is intended to enter the inlet of the cooling device in a first direction and is intended to exit the plurality of pins in a second direction which is substantially equal to the first direction.

Advantageously, no pressure losses due to a change in the flow direction are generated, thus improving the efficiency of this cooling device.

In some particular embodiments, the plurality of fins and the plurality of pins protrude from the heat sink. This is an advantageous way of achieving the thermal connection between the heat sink and the plurality of fins and pins. In some particular embodiments, the plurality of fins and the plurality of pins form the same angle with the heat sink. This arrangement is optimal, so that the flow goes through these elements with the few obstacles possible.

In some particular embodiments, the cooling device further comprises

- a first and a second walls protruding from the heat sink in such a way that the plurality of fins and the plurality of pins are enclosed by the first and second walls
- a plenum wall located opposite to the heat sink, so as to form a closed duct with the heat sink and the first and second walls.

These walls create a closed duct so that the flow does not scatter, thus maximizing the performance of the cooling device.

In some particular embodiments, the plurality of pins are arranged in at least four offset rows of pins, resulting a quincunx arrangement. This arrangement is optimal for the thermal performance of the cooling device. In more particular embodiments, each fin is straight and define a fin line as the prolongation of the fin, in such a way that all the fin lines are parallel; and the rows of pins are parallel to the fin lines, but the fin lines do not coincide with the rows of pins. This advantageous arrangement aims to make the air cross the pins in the best configuration possible: air exits the fins in current lines which are between two fin lines, and these current lines impact the row of pins, maximizing heat exchange.

In some particular embodiments

- the distance between two adjacent pins is comprised between 3 and 6 mm;
- the distance between two adjacent fins is comprised between 4 and 6 mm; and
- the distance between a fin and its closest pin is comprised between 3 and 5 mm In some particular embodiments, the plurality of pins have a frustoconical shape and the plurality of fins have a base and a top portion narrower than the base.

In some particular embodiments, the pins have a top diameter lower than 3 mm. In more particular embodiments, fins have a top portion which is between 1.5 mm and 2 mm wide. In more particular embodiments, the fins and pins protrude a height from the heat sink, this height being lower than 35 mm.

In a further inventive aspect, the invention provides an automotive luminous device comprising a cooling device according to the first inventive aspect and a light source arranged in thermal contact with the heat sink.

This automotive luminous device may be equipped with powerful light sources, since the cooling device is able to deal with the heat generated by the operation of such elements.

In some particular embodiments, the lighting device further comprises a first optical element arranged to receive light from the plurality of light sources and to shape the light into a light pattern projected outside the lighting device.

An optical element is an element that has some optical properties to receive a light beam and emit it in a certain direction and/or shape, as a person skilled in automotive lighting would construe without any additional burden.

In some particular embodiments, the optical element is at least one of a light guide, a lens, a reflector or a collimator.

These optical elements are useful to manage the light produced by the light source and provide uniform outlet.

In some particular embodiments, the light sources are solid-state light sources, such as light emitting diodes (LEDs).

The term "solid state" refers to light emitted by solid-state electroluminescence, which uses semiconductors to convert electricity into light. Compared to incandescent lighting, solid state lighting creates visible light with reduced heat generation and less energy dissipation. The typically small mass of a solid-state electronic lighting device provides for greater resistance to shock and vibration compared to brittle glass tubes/bulbs and long, thin filament wires. They also eliminate filament evaporation, potentially increasing the life span of the illumination device. Some examples of these types of lighting comprise semiconductor light-emitting diodes (LEDs), organic light-emitting diodes (OLED), or polymer light-emitting diodes (PLED) as sources of illumination rather than electrical filaments, plasma or gas.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

DETAILED DESCRIPTION OF THE INVENTION

Figure 1:
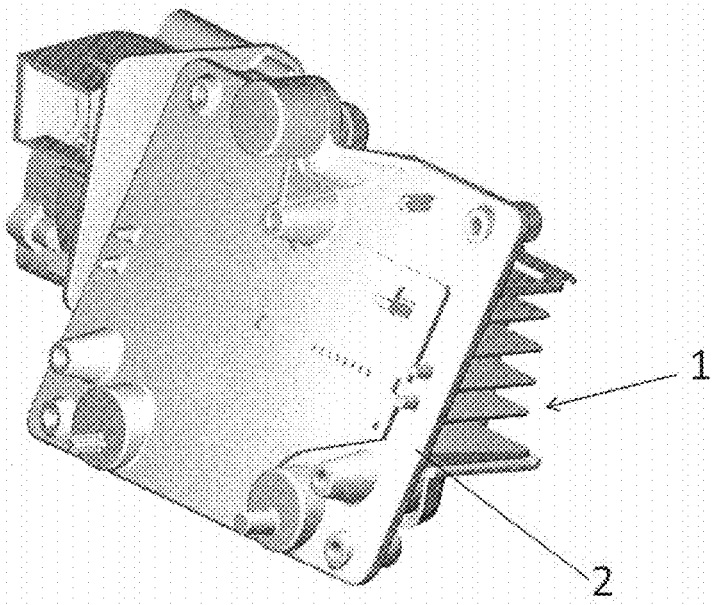
FIG. 1 shows a particular embodiment of a cooling device according to the invention.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In this text, the term "comprises" and its derivations (such as "comprising", etc.) should not be understood in an excluding sense, that is, these terms should not be interpreted as excluding the possibility that what is described and defined may include further elements, steps, etc.

FIG. 1 shows a perspective front view of a particular embodiment of a cooling device 1 according to the invention. This cooling device 1 is intended to be part of a headlamp and comprises a heat sink 2 which is in thermal contact with a plurality of LEDs which provide a light beam functionality.

Figure 2:
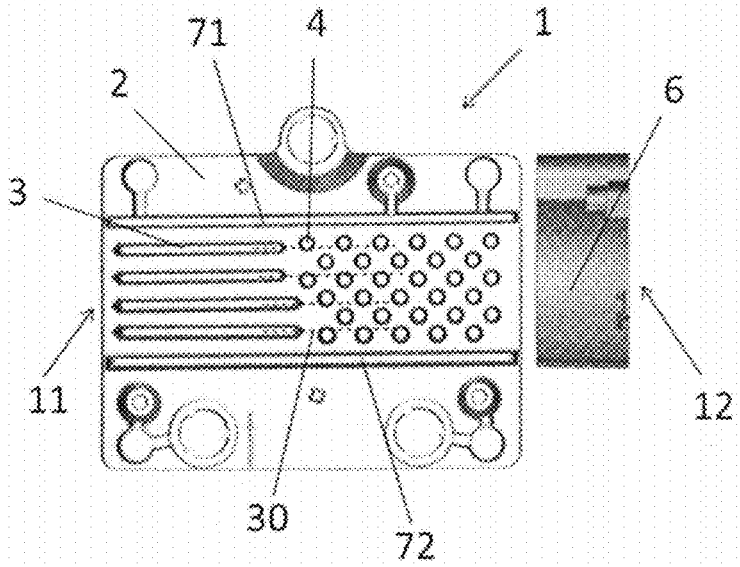
FIG. 2 shows a more detailed view of such a cooling device.

FIG. 2 shows a cut view of such a cooling device 1, so that the elements contained in the cooling device 1 may be seen. This cooling device comprises an inlet 11 for air intake and an outlet 12 for air exit.

Firstly, the cooling device 1 of this figure comprises a plurality of fins 3 which directly protrude from the heatsink 2. As may be seen in this figure, all of these fins 3 are parallel and each one defines a fin line 30 as the prolongation of their shapes.

Secondly, this cooling device 1 further comprises a plurality of pins 4 which directly protrude from the heatsink 2. As may be seen in this figure, all of these fins 3 protrude from the heat sink and are arranged in rows. These rows are offset, thus forming a quincunx arrangement. Further, each row is located between two different fin lines 30, so as not to coincide with any of them.

Finally, this cooling device comprises a fan 6. This fan is located at the outlet 12 of the cooling device 1 so that, when the cooling device 1 is in operation, air is sucked from the fan, and is forced to cross the fins, then the pins, then the fan and then exits the cooling device.

The linear arrangement of the plurality of fins, the plurality of pins and the fan makes that air enters the inlet of the cooling device in a first direction and exits the plurality of pins in a second direction which is substantially equal to the first direction, this direction being parallel to the fin lines 30. As a consequence, air follows a very straightforward path, with few pressure losses.

In this particular embodiment, these elements have been sized to cope with particular design conditions, and fins and pins have the following dimensions:

- the distance between two adjacent pins is approximately 4 mm;
- the distance between two adjacent fins is approximately 5 mm; and
- the distance between a fin and its closest pin is approximately 3 mm Further, pins have a frustoconical shape, with a top diameter of approximately 2.5 mm. Further, fins have a base which is wider than the top portion, and this top portion is approximately 1.8 mm wide.

However, for different applications, these dimensions may be different.

Figure 3:
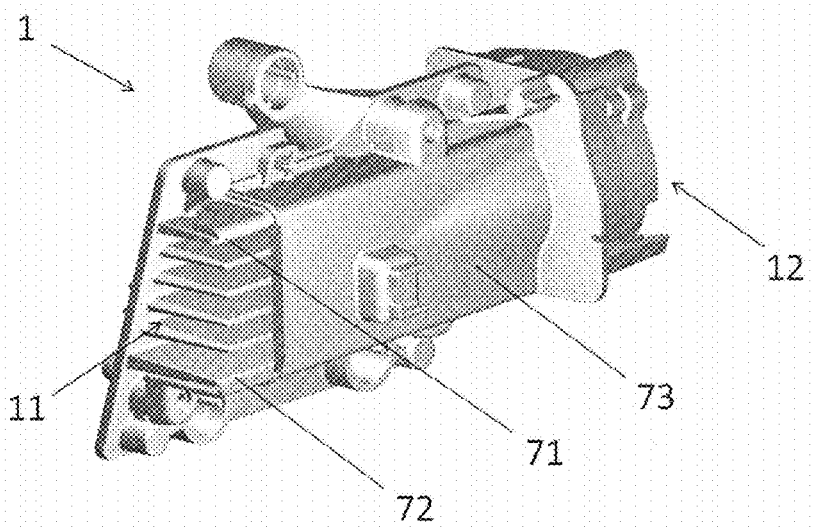
FIG. 3 shows a perspective rear view of the cooling device.

FIG. 3 shows a perspective rear view of the cooling device 1 to show the external elements which form a closed duct for air to flow from the inlet 11 to the outlet 12.

Air flow is surrounded by a first and a second walls 71, 72, which also protrude from the heat sink 2 in the same direction as the fins and the pins. A close duct is completed by a plenum wall 73 which is parallel to the heat sink. The first and second walls 71, 72 are already shown in FIG. 2, but the plenum wall 73 was cut in that figure so that the different elements comprised in the interior of the cooling device may be seen.

Figure 4:
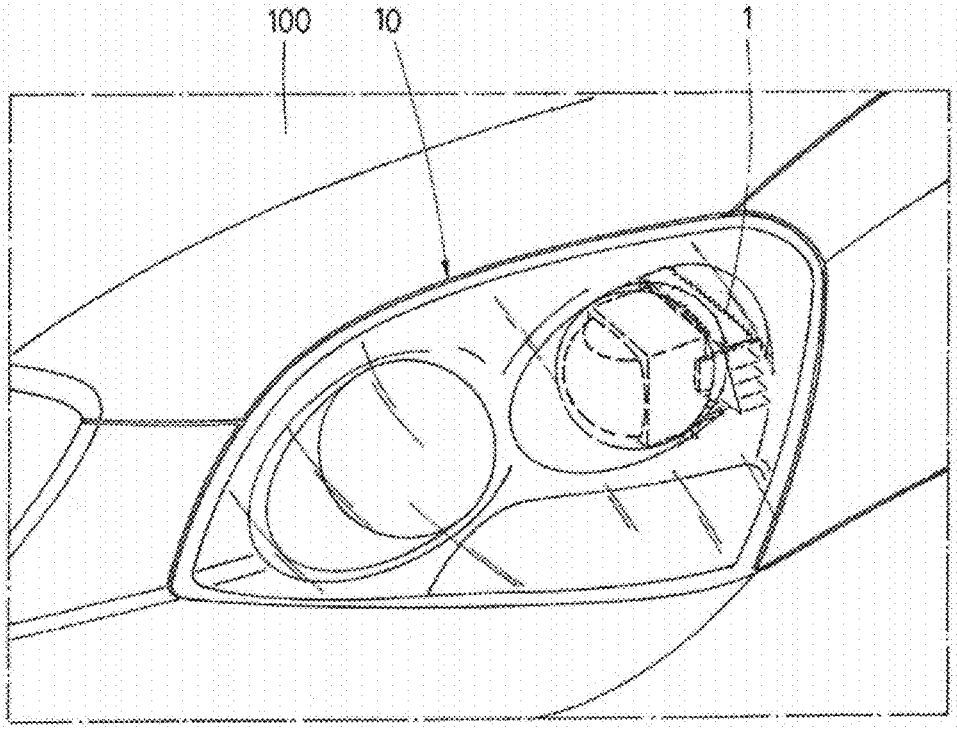
FIG. 4. shows the automotive lighting device shown in the previous figures mounted on an automotive vehicle.

FIG. 4 shows the automotive lighting device 10 shown in the previous figures mounted on an automotive vehicle 100. This lighting device 10, which provides a low beam functionality, may be equipped with powerful LEDs, the heat generated thereby being dissipated by the cooling device 1.

The invention claimed is:

1. A cooling device for cooling a light source located in an automotive luminous device, the cooling device comprising:

a heat sink in thermal contact with the light source, a plurality of fins in direct thermal contact with the heat sink and extending from the heat sink in a vertical direction therefrom;

a plurality of pins in direct thermal contact with the heat sink and extending from the heat sink in a vertical direction therefrom; and a fan arranged to make a fluid flow from an inlet of the cooling device to an outlet of the cooling device, where the plurality of fins are nearer to the inlet than the plurality of pins, wherein along a longitudinal direction of the heat sink, the area of the heat sink from which the plurality of fins extend is before the area of the heat sink from which the plurality of pins extend, the plurality of pins are arranged in at least four offset rows of pins, resulting a quincunx arrangement, each fin is straight and defines a fin line as the prolongation of the fin, in such a way that all the fin lines are parallel, and the rows of pins are parallel to the fin lines, but the fin lines do not coincide with the rows of pins.

2. The cooling device according to claim 1, wherein the fan is nearer to the inlet than the plurality of fins.

3. The cooling device according to claim 1, wherein the fan is nearer to the outlet than the plurality of pins.

4. The cooling device according to claim 1, wherein when the fluid is moved by the fan, it enters the inlet of the cooling device in a first direction and exits the plurality of pins in a second direction which is substantially equal to the first direction.

5. The cooling device according to claim 1, wherein the plurality of fins and the plurality of pins protrude from the heat sink.

6. The cooling device according to claim 5, wherein the plurality of fins and the plurality of pins form the same angle with respect to the heat sink.

7. The cooling device according to claim 6, wherein the plurality of pins have a frustoconical shape and the plurality of fins have a base and a top portion narrower than the base.

8. The cooling device according to claim 1, further comprising a first wall and a second wall, both first and second walls protruding from the heat sink in such a way that the plurality of fins and the plurality of pins are enclosed by the first and second walls;

a plenum wall located opposite to the heat sink, so as to form a closed duct with the heat sink and the first and second walls.

9. The cooling device according to claim 1, wherein the distance between two adjacent pins is between 3 and 6 mm;

the distance between two adjacent fins is between 4 and 6 mm; and the distance between a fin and its closest pin is between 3 and 5 mm.

10. An automotive luminous device comprising a cooling device according to claim 1; and a light source arranged in thermal contact with the heat sink.

11. The automotive luminous device according to claim 10, further comprising a first optical element arranged to receive light from the light source and to shape the light into a light pattern projected outside the automotive luminous device.

12. The automotive luminous device according to claim 11, wherein the optical element is at least one of a lens, a light guide, a reflector or a collimator.

13. The automotive luminous device according to claim 10, wherein the light source is a solid-state light source, including, a light emitting diode or LED.

14. The cooling device according to claim 2, wherein the plurality of fins and the plurality of pins protrude from the heat sink.

15. The cooling device according to claim 2, further comprising a first wall and a second wall, both first wall and second wall protruding from the heat sink in such a way that the plurality of fins and the plurality of pins are enclosed by the first and second walls;

a plenum wall located opposite to the heat sink, so as to form a closed duct with the heat sink and the first and second walls.

16. The cooling device according to claim 2, wherein the plurality of pins are arranged in at least four offset rows of pins, resulting a quincunx arrangement.

17. The automotive luminous device according to claim 11, wherein the light source is a solid-state light source, including, a light emitting diode or LED.

18. The cooling device according to claim 3, wherein the plurality of fins and the plurality of pins protrude from the heat sink.

19. A cooling device for cooling a light source located in an automotive luminous device, the cooling device comprising:

a heat sink in thermal contact with the light source, a plurality of fins in direct thermal contact with the heat sink;

a plurality of pins in direct thermal contact with the heat sink; and a fan arranged to make a fluid flow from an inlet of the cooling device to an outlet of the cooling device, where the plurality of fins are nearer to the inlet than the plurality of pins, wherein when the fluid is moved by the fan, it enters the inlet of the cooling device in a first direction and exits the plurality of pins in a second direction which is substantially equal to the first direction, and the plurality of fins, the plurality of pins and the fan are linearly arranged.

* * * * *